US007255655B2

(12) United States Patent
Gojny

(10) Patent No.: US 7,255,655 B2
(45) Date of Patent: Aug. 14, 2007

(54) HYBRID COMPOSITE GOLF BALL AND METHOD OF MANUFACTURE

(75) Inventor: Francis Joseph Gojny, Bonita, CA (US)

(73) Assignee: Element 21 Corp., Toronto (CA)

( * ) Notice: Subject to any disclaimer, the term of this patent is extended or adjusted under 35 U.S.C. 154(b) by 0 days.

(21) Appl. No.: 10/634,515

(22) Filed: Aug. 4, 2003

(65) Prior Publication Data

US 2005/0032589 A1 Feb. 10, 2005

(51) Int. Cl.
*A63B 37/06* (2006.01)

(52) U.S. Cl. ..... 473/373

(58) Field of Classification Search ..... 473/378, 473/351, 373, 374
See application file for complete search history.

(56) References Cited

U.S. PATENT DOCUMENTS

| | | | | |
|---|---|---|---|---|
| 5,427,378 | A * | 6/1995 | Murphy | 473/353 |
| 5,620,652 | A | 4/1997 | Tack et al. | 420/532 |
| 5,935,021 | A * | 8/1999 | Kashiwagi et al. | 473/365 |
| 6,193,617 | B1 * | 2/2001 | Mertens | 473/351 |
| 6,454,666 | B1 * | 9/2002 | Shira | 473/377 |
| 6,464,600 | B2 | 10/2002 | Takemura et al. | 473/378 |
| 6,554,723 | B1 * | 4/2003 | Kametani et al. | 473/378 |
| 2001/0019969 | A1 * | 9/2001 | Binette et al. | 473/354 |

* cited by examiner

*Primary Examiner*—Raeann Trimiew
(74) *Attorney, Agent, or Firm*—Gene Scott; Patent Law & Venture Group

(57) ABSTRACT

A golf ball comprising a spherical solid core covered by a spherical shell cover, the cover made of a composite material including one of a plastic and a rubber compounded with a metallic flake.

10 Claims, 1 Drawing Sheet

HYBRID COMPOSITE GOLF BALL AND METHOD OF MANUFACTURE

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

FIELD OF THE INVENTION

This invention relates generally to golf balls, and more particularly to a golf ball construction containing metallic flakes.

DESCRIPTION OF RELATED ART

The following art defines the present state of this field:

Takemura, et al., U.S. Pat. No. 6,464,500 describes a golf ball having high rebound characteristics and exceptional controllability at approach shot from the rough, which is accomplished by controlling its cover material morphology. The present invention relates a golf ball comprising a core and a cover covering the core, wherein the base resin of the cover is formed from a material having at least two phases whose phase angle difference is at least 2 degrees as measured by using an atomic force microscope; a maximum phase angle phase, which is contained in the base resin of the cover and has an absolute value of a maximum phase angle, is present in the form of a continuous matrix; and a minimum phase angle phase, which has an absolute value of a minimum phase angle, is present in discrete locations within the matrix.

Tack et al., U.S. Pat. No. 5,620,652 describes applications for aluminum alloys containing scandium with or without zirconium additions. Such modified aluminum alloys possess enhanced properties and exhibit improved processing characteristics, and, as such, are especially suited for use in recreational and athletic structures and components, and in certain aerospace, ground transportation and marine structures and components.

Our prior art search with abstracts described above teaches golf ball construction and materials such as aluminum alloys containing scandium with zirconium additions which are advantageous in recreational and athletic structures, but does not teach a golf ball construction using metal flakes to advantage. The present invention fulfills these needs and provides further related advantages as described in the following summary.

SUMMARY OF THE INVENTION

The present invention teaches certain benefits in construction and use which give rise to the objectives described below.

A golf ball comprising a spherical solid core covered by a spherical shell cover, the cover made of a composite material including one of a plastic and a rubber compounded with a metallic flake and injection molded into a final part structure. Preferably, the flake are aligned relative to the outer surface of the ball to form a metallic spring like structure with a very high coefficient of resilience.

A primary objective of the present golf ball invention is to provide the golf ball and its method of manufacture that provides advantages not taught by the prior art.

Another objective is to provide such a golf ball capable of being adjusted in its manufacture to a desired level of rebound capability and feel during the instant of impact with a driver golf club.

A further objective is to provide such an invention capable of improved visual appearance so as to be more easily seen when hidden in the rough of a golf course range.

A still further objective is to provide such an invention capable of improved performance and longer performance life.

A still further objective is to provide such an invention capable of improved consistency of rebound characteristics during a game of golf.

A still further objective is to provide such an invention capable of longer useful life due to improved wear resistance.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

A hybrid composite golf ball 10 contains plural metallic flakes (flake 20, or alternately describable as small or fine platelets), which are integrated within one or more layers of the balls construction. The flake is blended or compounded into a base material such as a polymer, ionomer, thermoplastic elastomer, rubber based material, or a combination thereof and together, the flake and the base material, comprise a "composite" material. This composite material will vary depending upon its use, i.e., for the core 12 of the golf ball 10 or the casing or cover 14 of the golf ball 10. A solid core 12 may, for instance, be constructed of a composite of a rubber, an organic peroxide and a cross-linking agent.

The composite material has a third order of magnitude strength, as traditionally defined in descriptions of composite materials in the art. This composite golf ball is highly suited for the level of impact, recovery and deformation experienced in the game of golf.

The flake used in this invention is of a metallic alloy having high moduli, tensile strength and fracture toughness as well as appropriate energy storing and release properties. Preferably, the flake is incorporated into the golf ball's cover, thereby providing an improved resistance to deformation. Such resistance can be varied as desired depending upon the ratio of flake to base material. This enables adjustment of the "feel" of the ball during a drive, as desired.

During the manufacturing process, injection molding, as the composite material flows into a mold, each of the flakes tends to naturally align its flat surfaces parallel to the mold's surfaces forming a brick-wall-like arrangement with overlapping peripheral flake edges. This produces a greater spring-back recovery property in the golf ball.

Variations in the ratio of flake to base material accommodates a range of desired golf ball characteristics. For instance a harder base material with a high ratio of flake to base material results in improved rebound velocity and spin, while a softer base material with a low ratio of flake to base material results in opposite characteristics and a "soft" feel. In all configurations, however, rebound velocities are greater than with conventional golf balls where metallic flake is not incorporated.

Figure 1:
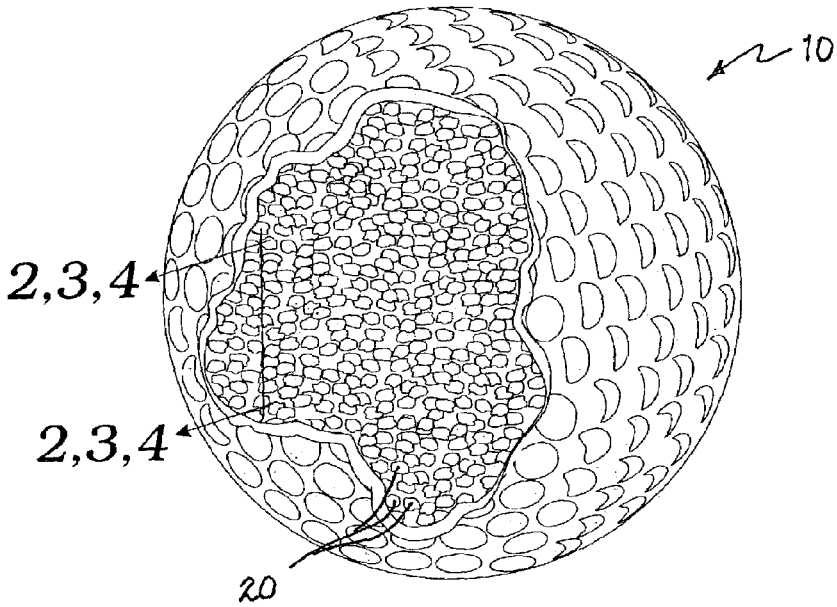
FIG. 1 is a view of the preferred embodiment of the invention.
Figure 2:
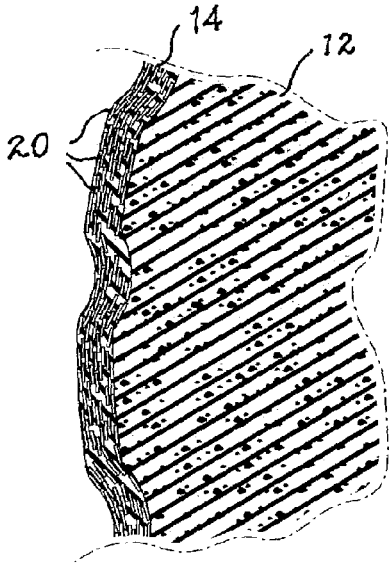
FIGS. 2-4 are enlarged section views taken along line 2-2 in FIG. 1.
Figure 3:
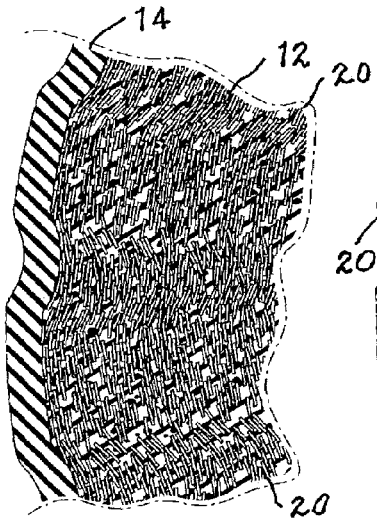
Figure 4:
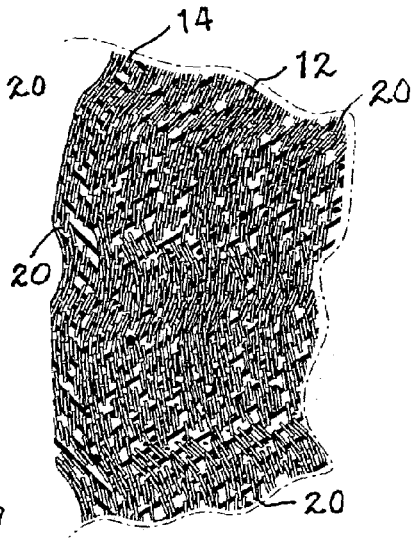

In constructing the present golf ball, the metallic flake may be applied to the ball's casing 12 only, as shown in FIG. 2, to the ball's interior or core 14 only, as shown in FIG. 3, or to both, as shown in FIG. 4. The core may be of a single material or may, itself, comprise plural layers, each of a different material, etc.

The incorporated and defined reference to Takemura et al fully describes a method for manufacturing a golf ball core. In the present invention it is preferable to compound a specific metallic flake. Preferable materials for such flake are titanium based alloys, aluminum alloys, nickel based alloys, iron based alloys or any other metallic or intermetallic alloy system having desired properties. In the preferred embodiment an aluminum-scandium alloy designated as 7xxx and described in the reference to Tack et al (U.S. Pat. No. 5,620,652) is the preferred alloy. This alloy not only is well suited to deliver a desirable dynamic response, bat also acts as a specific gravity regulator. Preferably, an amount of the flake is loaded at a volume fraction of 2.5 to 25%. The flake in the preferred embodiment has s 10-40 micron particle size with a 10 to 1 aspect ratio. More particularly, it has been found that a 2-10 particle size and 5 to 1 aspect ratio provides improved advantages.

The diameter of the core 14 is 36.8 to 41.2 mm, and preferably 37.8 to 40.8 mm. When the core diameter is smaller than 36.8 mm the cover is too thick, causing a poor rebound characteristic. However, when the core diameter is larger than about 41.2 mm, the cover is too thin and durability is poor. The core may be made up of more than one layer, but in the present invention, the core is a single monolithic shell. Measured radially, the cover is preferably between 0.5 and 5 mm and is more preferably within the range of between 0.6 and 4 mm. In the preferred embodiment, the cover is made from Surlyn 9320 ® an Ionomer resin from E. I. DuPont, Inc. As is traditional, the present invention golf ball is prepared with dimples in the outer surface. It may have between 300 and 600 dimples and preferably between 310-550 dimples. The golf ball of this invention is prepared in accordance with the rules of golf so as to have a diameter of not less then 42.67 mm and a weight of not greater than 45.93 grams.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A golf ball formed by an injection molding process within a mold having interior mold surfaces, the golf ball comprising a spherical core covered by a spherical shell cover, wherein at least one of the spherical core and the shell cover of the golf ball is made of a composite of a plastic and a rubber, compounded with a plurality of metallic flakes, each of the flakes having flat surfaces aligned parallel to the mold's interior surfaces resulting in a brick-wall-like arrangement with overlapping peripheral flake edges, whereby a desired spring-back recovery property in the golf ball is produced.

2. The golf ball of claim 1 wherein the plastic and a rubber composite is one of a polymer, ionomer, thermoplastic elastomer, rubber based material, or a combination thereof.

3. The golf ball of claim 1 wherein the core is constructed of a composite of a rubber, an organic peroxide and a cross-linking agent.

4. The golf ball of claim 1 wherein the flake is of a metallic alloy having high moduli, tensile strength and fracture toughness.

5. The golf ball of claim 1 wherein the metallic flakes are of a material including at least one of: titanium based alloys, aluminum alloys, nickel based alloys, and iron based alloys.

6. The golf ball of claim 1 wherein the metallic flakes comprise between 2.5% and 25% of the volume of the golf ball.

7. The golf ball of claim 1 wherein the metallic flakes comprise a particle size of between 10 microns and 40 microns.

8. The golf ball of claim 1 wherein the metallic flakes comprise a particle size of between 2 microns and 10 microns.

9. The golf ball of claim 1 wherein the metallic flakes comprise an aspect ratio of between 5 to 1 and 10 to 1.

10. The golf ball of claim 1 wherein the cover has a thickness of between about 0.5 mm and 5.0 mm.

* * * * *